United States Patent [19]

Sauber et al.

[11] Patent Number: 4,942,959

[45] Date of Patent: Jul. 24, 1990

[54] BUOYANT STRUCTURES IN CONTACT LENS CASE

[76] Inventors: Charles J. Sauber, 10 N. Sauber Rd., Virgil, Ill. 60182; Janet E. Truhler, 311 Woodridge Dr., Vadnais Heights, Minn. 55110

[21] Appl. No.: 425,103

[22] Filed: Oct. 23, 1989

[51] Int. Cl.[5] ..... A45C 11/04

[52] U.S. Cl. ..... 206/5.1; 422/301; 134/137

[58] Field of Search ..... 206/5.1, 205, 207; 422/301; 134/137, 138

[56] References Cited

U.S. PATENT DOCUMENTS

| | | | |
|---|---|---|---|
| 3,089,500 | 5/1963 | Stalcup | 206/5.1 |
| 3,379,200 | 4/1968 | Pennell | 206/5.1 |
| 3,741,377 | 6/1973 | Krellen | 206/5.1 |
| 4,415,076 | 11/1983 | Campbell | 206/5.1 |
| 4,782,946 | 11/1988 | Pollak | 206/5.1 X |
| 4,860,885 | 8/1989 | Kaufman et al. | 206/5.1 |

FOREIGN PATENT DOCUMENTS

| | | | |
|---|---|---|---|
| 631248 | 12/1961 | Italy | 206/5.1 |

*Primary Examiner*—Bryon P. Gehman

*Attorney, Agent, or Firm*—Leydig, Voit & Mayer

[57] ABSTRACT

An improved contact lens carrying case has a pair of contact lens storage compartments integrally formed on a base member and includes a pair of respective storage compartment caps. Each storage compartment includes a lens retrieval structure, which is a free floating pop-up lens retrieval structure. The lens retrieval structure moves from an immersed position when the storage compartment cap is closed to a raised contact lens retrieval position when the storage compartment cap is opened. The lens retrieval structure has a convex upper surface and an outer upstanding flange. The upstanding flange is contacted by a plurality of fingers formed in the bottom of the cap to immerse the lens retrieval structure when the cap is closed. The lens retrieval structure is retained in the storage compartment by mating flanges on the inside of the upper open end of the storage compartment and on the outside of the lens retrieval structure.

20 Claims, 1 Drawing Sheet

BUOYANT STRUCTURES IN CONTACT LENS CASE

FIELD OF THE INVENTION

The present invention relates generally to a contact lens carrying case, and more particularly is directed to an improved contact lens carrying case which has a free floating pop-up structure to raise the contact lens out of the solution in the contact lens carrying case when the lid of the contact lens compartment is raised to retrieve the contact lens.

BACKGROUND OF THE INVENTION

Contact lenses are generally stored and carried in some type of contact lens carrying case. Typically the cases are designed to hold a suitable soaking and/or cleansing fluid or solution into which the contact lenses are immersed when the contact lens carrying cases are closed. While it is desired to maintain the contact lens immersed in the solution, it also is desirable to substantially eliminate contact by the user with the sterile solution and spillage or overflow of the solution while providing easy access to the contact lens.

These needs have led to numerous prior art contact lens carrying case designs having varying complexity from contact lens carrying cases with merely lid covered solution compartments to structures having various manual or automatic lens retrieval structures. Two types of manual lens retrieval structures are disclosed in U.S. Pat. Nos. 3,054,412 ('412) and 3,444,868 ('868). The '412 patent includes a pair of individual receptacles each having a concave shaped piston independently movable by a finger piece to move the contact lens into and out of the solution. The '868 patent includes individual lens compartments formed in the same platform, which platform manually is movable into and out of the solution.

Two types of automatic lens retrieval structures are disclosed in U.S. Pat. Nos. 3,070,105 ('105) and 3,460,552 ('552). The '552 patent includes a tubular double-ended contact lens carrying case, with a spring biased concave-shaped piston opening to either end. When the cap of the case is rotated or unscrewed open, the piston is urged by the spring to move the contact lens out of the solution. The '552 patent includes a spring biased platform with two lens compartments formed therein. When the cap of the case is rotated or unscrewed, the whole platform is urged out of the solution and then the individual lens compartment lids manually are raised to retrieve the contact lens.

It would be desirable to provide a contact lens carrying case, which automatically retrieves the contact lens from the solution when a lens compartment lid is opened, formed from a minimum number of non-complex parts.

OBJECTS AND SUMMARY OF THE INVENTION

It is, therefore, a primary object of the present invention to provide an improved contact lens carrying case having an automatic lens retrieval structure.

A further object of the present invention is to provide an improved contact lens carrying carrying case which has a minimal number of components which easily can be manufactured.

It is yet another object of the present invention to provide an improved contact lens carrying case having individual free floating pop-up type lens retrieval structures for each contact lens.

In general, the present invention contemplates a contact lens carrying case having a base member in which are formed a pair of contact lens storage compartments. The contact lens storage compartments can be covered and uncovered by caps which are hinged to the base member. Each storage compartment includes a free floating pop-up lens retrieval structure having an immersed position when the cap is closed and a raised contact lens retrieval position when the cap is opened. The storage compartment and the lens retrieval structure have flanges which engage to retain the lens retrieval structure in the storage compartment.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
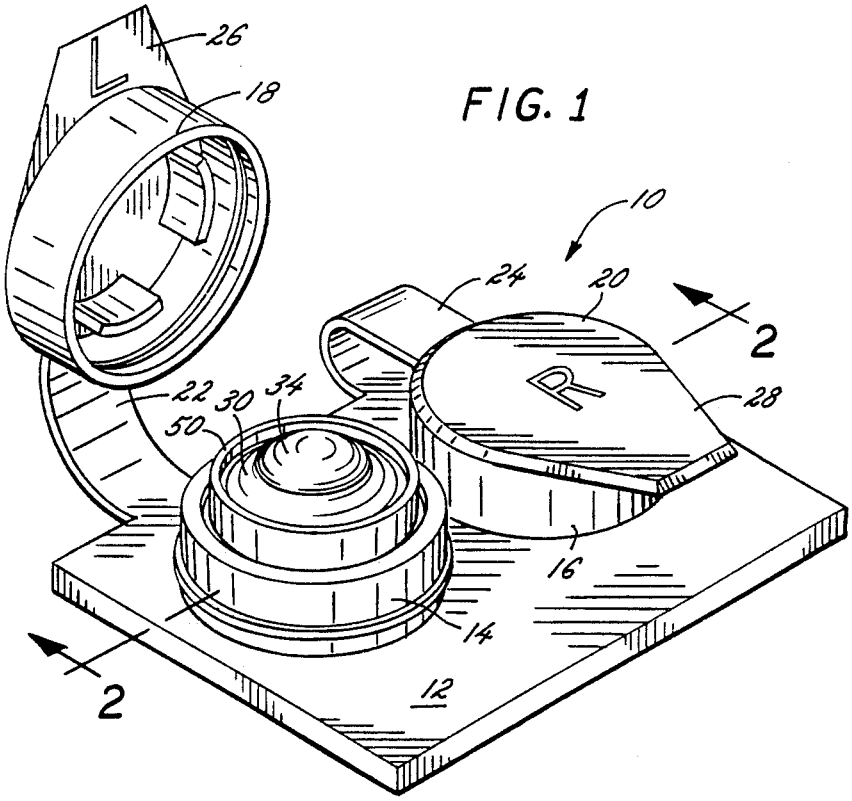
FIG. 1 is a perspective view of an improved contact lens carrying case in accordance with the present invention.
Figure 2:
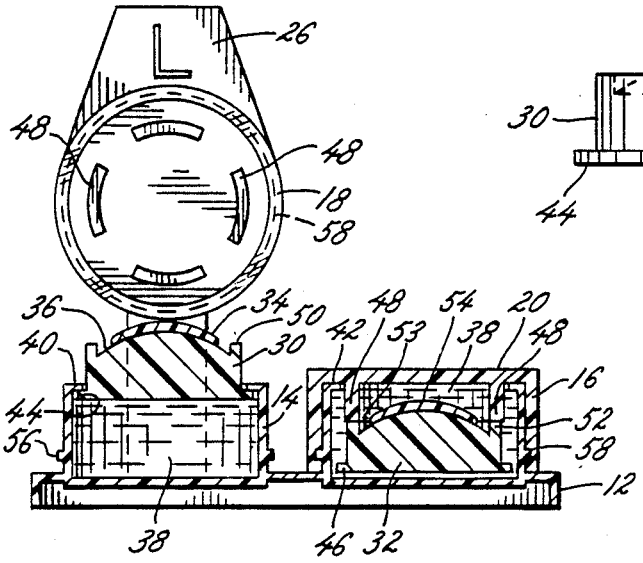
FIGS. 2*a* and 2*b* are a cross-sectional view of the contact lens carrying case shown in and taken along the line 2*a*–2*b* in FIG. 1.
Figure 3:
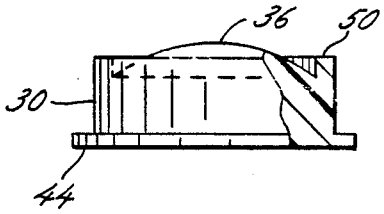
FIG. 3 is a side plan view, partially in section of one pop-up lens retrieval structure of the present invention.

Turning to the drawings, there is shown in FIG. 1 an improved contact lens carrying case of the present invention generally indicated by the reference numeral 10. The contact lens carrying case 10 includes a base member 12, two individual lens storage compartments 14, 16 and two individual lens storage compartment caps 18, 20. The base 12, storage compartments 14, 16 and storage compartment caps 18, 20, preferably are formed in one piece from a suitable flexible plastic-like or polyethylene material. The storage compartment caps 18, 20 preferably are joined to the base 12 by flexible one-piece living hinges 22, 24.

The caps 18, 20 preferably form a snap-tight closure over the outside of the storage compartments 14, 16. The caps 18, 20 preferably include lift tabs 26, 28 to assist the user in opening the storage compartments 14, 16. The caps 18, 20 and tabs 26, 28 also include indicia "L" and "R" to eliminate confusion by the user as to which storage compartment 14, 16 each contact lens belongs in.

Although the preferred embodiment of the contact lens carrying case 10 is described as a flat type case, the present invention can be utilized equally well with other types of contact lens carrying cases. The caps 18, 20 can be screw type caps, which are not hinged to the base 12. The storage compartments 14, 16 can be formed on opposite sides of the base 12. The contact lens carrying case 10 can be a tubular, double ended case with screw type caps, one on each end and a dividing wall to form the two lens compartments.

The structures described heretofore essentially are conventional. The improvement in the contact lens carrying case 10 is provided by a pair of free-floating pop-up lens retrieval structures 30, 32, as best illustrated in FIGS. *2a*, *2b* and 3. A left contact lens 34 rests on a top convex surface 36 of the lens retrieval structure 30 for easy retrieval by the user without contacting or with minimal contact with a soaking/cleansing solution 38 contained in the storage compartments 14, 16.

Each storage compartment 14, 16 includes an upper inwardly extending flexible flange 40, 42, which retains the free floating pop-up lens retrieval structures 30, 32 in the storage compartments 14, 16. Each lens retrieval structures 30, 32 has a bottom flexible flange 44, 46 extending outwardly therefrom to engage the respective storage compartment flanges 40, 42. The flanges 44, 46 can be integrally formed or can be a plurality of tabs, but in any case, the width of the flanges 44, 46 provides a clearance space between the flanges 44, 46 and the inner walls of the storage compartments 14, 16.

When the caps 18, 20 are closed, a plurality of fingers 48 formed in the bottom of the caps 18, 20 bear against a mating flange or wall 50, 52 formed at the top of the lens retrieval structures 30, 32. The flanges or walls 50, 52 again can be integrally formed, or can include slots or apertures (not illustrated) to allow the solution 38 to drain from the top surface 36 when the storage compartments 14, 16 are opened. When the caps 18, 20 are closed, as illustrated by the cap 20, the lens retrieval structure 32 is forced toward the bottom of the storage compartment 16 as the solution 38 flows over a top convex surface 53 to immerse a right contact lens 54.

The contact lens 54 is illustrated in contact with the surface 53, but in general, would float in the solution 38. The surfaces 36, 53 could be grooved or have apertures therein to ensure that the contact lens 34 or 54 do not stick to the respective surface.

The caps 18, 20 can snap fit over snap ridges 56, 58 formed on the outside of the storage compartments 14, 16 if desired. The lens retrieval structures 30, 32 can be formed of any suitable material, having a density which will cause the lens retrieval structures 30, 32 to be buoyant and free float in the solution 38. When the caps 18, 20 are closed, the storage compartments 14, 16 preferably are dimensioned, such that the solution 38 completely surrounds the lens retrieval structures 30, 32 to ensure the free floating thereof.

The improved contact lens carrying case 10 is easily and inexpensively manufacturable and includes a total of only three separate elements. The free floating pop-up lens retrieval structures 30, 32 provide automatic retrieval of the lens 34, 54, without manual or spring action and avoid spillage or contamination of the solution 38 as above mentioned, the structures 30, 32 can be utilized in numerous contact lens carrying case configurations.

We claim as our invention:

1. An improved contact lens carrying case, comprising:

a base member including two contact lens storage compartments, each having an open end and adapted to hold a contact lens solution therein;

a pair of storage compartment caps moveable from a first closed position, closing a respective storage compartment open end, to a second open position, uncovering the respective storage compartment open end; and free floating pop-up lens retrieval structures located in each storage compartment, each of said structures having a density less than the contact lens solution enabling said structures to be buoyant, said structures being operably moveable to a first immersed position when said cap is in the closed position, and buoyantly rising in the contact lens solution to a second lens retrieval position adjacent said storage compartment open end when said cap is in the open position.

2. The improved contact lens carrying case of claim 1 wherein each said storage compartment open end includes at least one member extending therein and each said lens retrieval structure includes a mating member extending from a bottom portion thereof to contact said storage compartment member to prevent said lens retrieval structure from leaving said storage compartment.

3. The improved contact lens carrying case of claim 2 wherein said storage compartment member is a flange extending inwardly substantially around said open end and said lens retrieval structure mating member is a second mating flange extending outwardly substantially around said lens retrieval structure.

4. The improved contact lens carrying case of claim 1 wherein said lens retrieval structure has a convex upper surface, adapted to mate with a concave surface of a contact lens.

5. The improved contact lens carrying case of claim 1, wherein each said lens retrieval structure has an upstanding flange around an upper periphery thereof and each said storage compartment cap has at least one mating projection for biasing against said upstanding flange as said lid is moved to said first closed position.

6. The improved contact lens carrying case of claim 5 wherein said lens retrieval structure has a convex upper surface, adapted to mate with a concave surface of a contact lens.

7. The improved contact lens carrying case of claim 1 wherein said base member is a flat type member with said contact lens storage compartments formed on one side thereof and said storage compartment caps are hingedly secured to said base member.

8. The improved contact lens carrying case of claim 7 wherein said base member, storage compartments and storage compartment caps are integrally formed in one piece.

9. An improved contact lens carrying case including two contact lens storage compartments each having an open end and adapted to hold a contact lens solution therein, a pair of storage compartment caps moveable from a first closed position, closing a respective storage compartment open end, to a second open position, uncovering the respective storage compartment open end, said improvement comprising:

free floating pop-up lens retrieval structures located in each storage compartment, each of said structures having a density less than the contact lens solution, said structures being operably moveable from a first immersed position, when said cap is in the closed position, and buoyantly rising in the contact lens solution to a second lens retrieval position, adjacent said storage compartment open end when said cap is in the open position.

10. The improved contact lens carrying case of claim 9 wherein each said storage compartment open end includes at least one member extending therein and each said lens retrieval structure includes a mating member extending from a bottom portion thereof to contact said storage compartment member to prevent said lens retrieval structure from leaving said storage compartment.

11. The improved contact lens carrying case of claim 10, wherein said storage compartment member is a flange extending inwardly substantially around said open end and said lens retrieval structure mating member is a second mating flange extending outwardly substantially around said lens retrieval structure.

12. The improved contact lens carrying case of claim 9 wherein said lens retrieval structure has a convex upper surface, adapted to mate with a concave surface of a contact lens.

13. The improved contact lens carrying case of claim 9, wherein each said lens retrieval structure has an upstanding flange around an upper periphery thereof and each said storage compartment cap has at least one mating projection for biasing against said upstanding flange as said lid is moved to said first closed position.

14. The improved contact lens carrying case of claim 13, wherein said lens retrieval structure has a convex upper surface, adapted to mate with a concave surface of a contact lens.

15. The improved contact lens carrying case of claim 9 including a flat type base member with said contact lens storage compartments formed on one side thereof and said storage compartment caps hingedly secured to said base member.

16. The improved contact lens carrying case of claim 15 wherein said base member, storage compartments and storage compartment caps are integrally formed in one piece.

17. An improved contact lens carrying case, comprising:

a base member including two contact lens storage compartments each having an open end and adapted to hold a contact lens solution therein, each said storage compartment open end includes at least one member extending therein, each said storage compartment member is a flange extending inwardly substantially around said open end;

a pair of storage compartment caps moveable from a first closed position, closing a respective storage compartment open end, to a second open position, uncovering the respective storage compartment open end;

free floating pop-up lens retrieval structures located in each storage compartment, each of said structures having a density less than the contact lens solution enabling said structures to be buoyant, said structures being operably moveable to a first immersed position when said cap is in the closed position, and buoyantly rising in the contact lens solution to a second lens retrieval position adjacent said storage compartment open end when said cap is in the open position, each said lens retrieval structure includes a mating member extending from a bottom portion thereof to contact said storage compartment member to prevent said lens retrieval structure from leaving said storage compartment, said lens retrieval structure mating member is a second mating flange extending outwardly substantially around said lens retrieval structure; and each said lens retrieval structure includes an upstanding flange around an upper periphery thereof and each said storage compartment cap includes at least one mating projecting for biasing against said upstanding flange as said lid is moved to said first closed position.

18. The improved contact lens carrying case of claim 17, wherein said lens retrieval structure has a convex upper surface, adapted to mate with a concave surface of a contact lens.

19. The improved contact lens carrying case of claim 17, wherein said base member is a flat type member with said contact lens storage compartments formed on one side thereof and said storage compartment caps are hingedly secured to said base member.

20. The improved contact lens carrying case of claim 19, wherein said base member, storage compartments and storage compartment caps are integrally formed in one piece.

* * * * *